US005383600A

United States Patent [19]

Verbera et al.

[11] Patent Number: 5,383,600

[45] Date of Patent: Jan. 24, 1995

[54] VANDAL RESISTANT PART CIRCLE POP-UP GEAR DRIVEN ROTARY IRRIGATION SPRINKLER

[75] Inventors: Steven Verbera, Glendora; Timothy C. Sexton, Walnut, both of Calif.

[73] Assignee: Anthony Manufacturing Corp., Azusa, Calif.

[21] Appl. No.: 143,082

[22] Filed: Oct. 25, 1993

[51] Int. Cl.[6] ..... B05B 3/04

[52] U.S. Cl. ..... 239/205; 239/206; 239/242; 239/263.3; 464/30

[58] Field of Search ..... 464/4, 7, 20, 30, 34; 239/203-206, 600, 240, 292

[56] References Cited

U.S. PATENT DOCUMENTS 2,962,312 11/1960 Wanner ..... 464/30

4,242,782 1/1981 Hannekes et al. ..... 464/30 X 4,626,112 12/1986 Kramer ..... 464/30 X 4,892,252 1/1990 Bruninga ..... 239/240 X

*Primary Examiner*—Andres Kashnikow

*Assistant Examiner*—Kevin P. Weldon

*Attorney, Agent, or Firm*—Kelly Bauersfeld & Lowry

[57] ABSTRACT

A vandal resistant part circle gear driven sprinkler having a plastic pop-up assembly including a nozzle housing rotatably mounted to a non-rotatable pop-up stem within which a reversible gear drive mechanism is mounted. A slip clutch is provided for mounting the reversible gear drive mechanism within the stem to prevent relative rotation during normal sprinkler operation, but which permits the mechanism to rotate relative to the stem whenever an external torque above a preselected level is applied to the nozzle housing.

8 Claims, 3 Drawing Sheets

VANDAL RESISTANT PART CIRCLE POP-UP GEAR DRIVEN ROTARY IRRIGATION SPRINKLER

FIELD OF THE INVENTION

This invention relates to part circle pop-up rotary irrigation sprinklers of the type employing a reversing gear drive mechanism mounted within the pop-up stem for effecting oscillation of the sprinkler nozzle, and more particularly, a new and improved mounting for the reversing gear drive mechanism within the stem to prevent sprinkler damage caused by excessive torque being applied to the sprinkler nozzle when the sprinkler is not operating.

BACKGROUND OF THE INVENTION

Presently, there are many gear driven part circle pop-up irrigation sprinklers available on the market, and which have an adjustable arc drive mechanism incorporating a water driven reversing gear drive for effecting oscillation of the sprinkler nozzle. Typically, such sprinklers are made from molded plastic parts, and employ a water driven turbine or impeller which rotates a gear train, the output of which is directed to a shiftable gear transmission having two oppositely rotating terminal gears which alternately engage a ring gear formed on the sprinkler nozzle to effect rotation of the nozzle in opposite directions. Shifting of the transmission to disengage one terminal gear from the nozzle ring gear and to move the other terminal into driving engagement with the ring gear is typically effected by a pair of arc limiting trip stops or tabs which rotate with the nozzle and operate a rotatable trip collar coupled with a shiftable gear carrier on which the terminal gears are mounted. As the nozzle rotates, one or the other of the trip stops engage a radially projecting trip arm on the trip collar causing the arm to deflect which, in turn, effects a shifting of the gear carrier and a movement of one terminal gear out of engagement with the nozzle ring gear and the other terminal gear into engagement with the ring gear.

Exemplary of part circle rotary pop-up irrigation sprinklers of the type to which the present invention relates are those disclosed in U.S. Pat. Nos. 3,713,584; 3,724,757; 4,634,052; 4,699,321; 4,708,291; 4,955,542; and 5,148,991 as well as such commercially available sprinklers as that known as the "Super 600" manufactured by The Toro Company, and the part-circle "T-Bird" sprinkler manufactured by Rain Bird Sprinkler Mfg. Corp., as shown on page 40 of its 1993–94 Landscape Irrigation Products catalogue. Each of these sprinklers has a reversing gear drive mechanism mounted within a non-rotating pop-up stem of the sprinkler, and employs an adjustable arc mechanism generally similar to that disclosed in U.S. Pat. No. 3,107,056.

Typically, the drive turbine, drive gearing and shiftable transmission are supported by a suitable housing or support structure which is mounted within the non-rotatable tubular stem of the sprinkler. Rotatably coupled to the stem above the drive is the nozzle assembly which includes means for adjusting the arc of rotation by adjusting the relative arcuate distance between the two trip stops. Normally, one trip stop is fixed with respect to the nozzle while the second can be selectively moved arcuately relative to the nozzle to increase or decrease the desired arc of sprinkler coverage. In the Toro "Super 600" and the Rain Bird "T-Bird" commercial sprinklers, the fixed trip stop is integrally formed as a downwardly projecting tab on a cup shaped member forming the nozzle ring gear, and the second adjustable trip stop is formed as a downwardly projecting tab on a concentrically mounted cup-shaped member coupled to the ring gear by a flexible serrated tooth connection, such as disclosed in the aforementioned U.S. Pat. No. 3,107,056.

Prior to the present invention, part circle pop-up rotary irrigation sprinklers of the type with which the present invention is intended to be used, employed some means such as welding, gluing, keying, and the like, to non-rotatably attach the drive mechanism and associated support housings to the inner wall of the pop-up stem so as to positively prevent relative rotation of the drive mechanism within the stem. This was believed to be necessary to ensure that when the sprinkler was assembled the drive mechanism would always have one fixed arc limit of rotation, that fixed limit being established by the position of the fixed trip stop attached to the ring gear. That is, since only one of the trip stops is arcuately adjustable relative to the other trip stop which is fixed in position to the nozzle, on assembly of the sprinkler, the fixed trip stop serves as a reference for one of the arcuate limits of nozzle rotation, and it was believed necessary to maintain that reference location at all times.

One major problem which has long plagued the art is that of vandalism caused by a forcible rotation of the sprinkler nozzle when the sprinkler is not in operation with sufficient torque to cause one of the trip stops to abut against the trip arm of the trip collar with sufficient force to effect a breakage of the plastic trip stop or trip arm, or to strip the plastic ring gear or the engaged terminal gear. Such overtorquing of the nozzle and the consequential breakage of internal plastic parts within the sprinkler renders the sprinkler essentially useless, therefore requiring expensive repair and/or replacement.

The present invention overcomes the problem of vandalism and the like created as a result of excessive torque being applied to the nozzle when the sprinkler is not in operation by providing a clutch which permits the drive motor and gear transmission to slip relative to the stem before breakage can occur. Thus, the present invention goes contrary to the traditional belief, and provides a structure which intentionally allows relative rotation between the drive mechanism and the stem within which it is mounted whenever excessive torque is applied to the sprinkler nozzle.

SUMMARY OF THE INVENTION

In accordance with the present invention, the drive mechanism is supported within the cylindrical non-rotatable stem through a friction slip clutch which maintains the drive mechanism in a fixed position relative to the stem unless and until a predetermined torque is applied to the nozzle at which time the drive mechanism will rotate within the stem until the applied torque is reduced below the preselected level. By suitably selecting the level of torque at which the slip clutch permits rotation of the drive mechanism relative to the stem, the position of the drive mechanism within the stem can be maintained during normal operation, yet positively prevent the possibility of internal breakage of sprinkler components upon the application of an excessive external torque.

More specifically, the present invention provides for frictional attachment of the drive mechanism within the stem through a friction coupling preferably formed by an elastomeric O-ring dimensioned to provide sufficient frictional resistance to prevent rotation of the drive mechanism relative to the stem at torque levels below that which could incur sprinkler part breakage or damage, but which can slip upon application of torque levels above the preselected level. The O-ring is mounted within a peripheral annular groove formed around a disk-shaped base forming a portion of the support housing to which the gear drive motor is attached, and on which the sprinkler shifting gear transmission is mounted. The O-ring is press-fit against the inside wall of the pop-up stem, and is dimensioned to apply a friction interface fitting between the base and stem that resists relative rotation below torque levels experienced during normal sprinkler operation, but permits slippage when excessive torque is applied, such as those which a vandal can apply.

Various other features and advantages of the present invention will become more apparent from the following detailed description taken in conjunction with the accompanying drawings which disclose, by way of example, the principles of the invention.

DETAILED DESCRIPTION OF THE PRESENTLY PREFERRED EMBODIMENT

Figure 1:
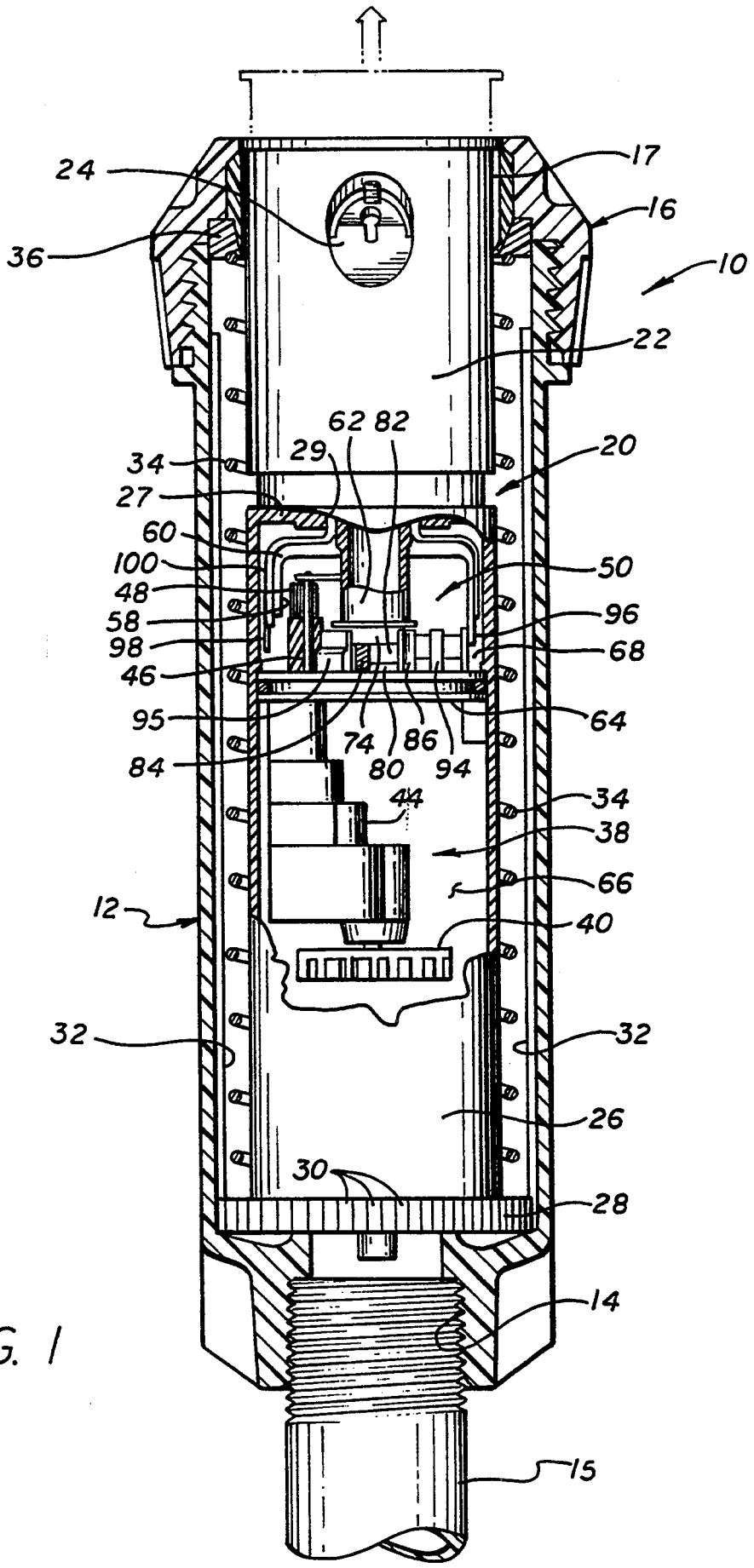
FIG. 1 is a perspective view, partly in cross-section, of a part-circle pop-up gear driven rotary sprinkler of the general type in which the present invention is intended to be used, and shown with portions of the sprinkler pop-up stem cut away to reveal internal parts.

As shown in the exemplary drawings, the present invention is primarily intended for use in part circle pop-up rotary irrigation sprinklers of the type employing a reversing gear drive mechanism mounted within the pop-up stem for effecting oscillation of the sprinkler nozzle. As shown in FIG. 1, the sprinkler, generally designated 10, with which the present invention is principally intended to be used, includes a cylindrical sprinkler case 12 which is adapted to be buried in the ground, and which includes an inlet opening 14 for coupling the sprinkler case with a supply pipe 15 communicating with a source of pressurized water (not shown). The upper end of the case 12 is closed by a cover 16 threadably coupled to the upper end of the case, and which includes a central opening 17 through which a sprinkler pop-up assembly, generally designated 20, is adapted to extend and retract.

In this instance, the sprinkler pop-up assembly 20 includes a rotatable nozzle housing 22 containing a nozzle 24 and which is mounted for rotation to the upper end of a cylindrical non-rotatable stem 26. As shown herein, the stem 26 is formed as a generally hollow cylinder having a large flange 28 at its lower end formed with a plurality of peripheral groves 30 which are adapted to mate with corresponding radially inwardly projecting ribs 32 formed at spaced locations along the length of the inside of the case 12. Mating of the peripheral grooves 30 with the ribs 32 prevents the stem 26 from rotating relative to the case 12 and allows an installer to select the initial arcuate position of the nozzle 24. Herein, a retraction coil spring 34 is disposed concentrically about the stem 26 and lower portion of the nozzle housing 22, and has one end abutting against the flange 28 and the other end abutting a spring retainer 36 mounted within the cover 16. Upon the application of water pressure through the inlet 14 of the case 12, the sprinkler pop-up assembly 20 will be forced upwardly through the opening 18 in the cover 16 to extend the stem 26 and nozzle housing 22 in the direction of the arrow of FIG. 1 to the operating position. Upon the completion of an irrigation cycle, when water pressure to the sprinkler 10 is relieved, the spring 34, which is compressed during extension of the sprinkler pop-up assembly 20, causes the sprinkler pop-up assembly to retract back into the case 12 so that the sprinkler pop-up assembly is fully contained within the case during nonirrigation, inoperative conditions.

Rotation of the nozzle housing 22 and nozzle 24 during operation of the sprinkler 10 is accomplished by a water operated motor, generally designated 38, mounted within the pop-up stem 26. In this instance, the motor 38 includes a turbine or impeller 40 which is rotated by the pressure of water entering the bottom of the stem 26 through the inlet 14 of the case 12, and which in turn rotates a gear train (not shown) disposed within an enclosed housing 44. Preferably, although not necessarily, the housing 44 within which the gear train is mounted forms a sealed internal chamber which may be filled with a suitable gear lubrication fluid. The gear train inside the housing 44 serves to convert the high speed low torque rotation of the impeller 40 to a lower speed, higher torque output which herein is directed upwardly through an output shaft 46 to a drive gear 48 forming part of a shiftable gear transmission, generally designated 50, which operates to oscillate the nozzle housing 22 and nozzle 24 back and forth for part circle sprinkler operation.

Figure 3:
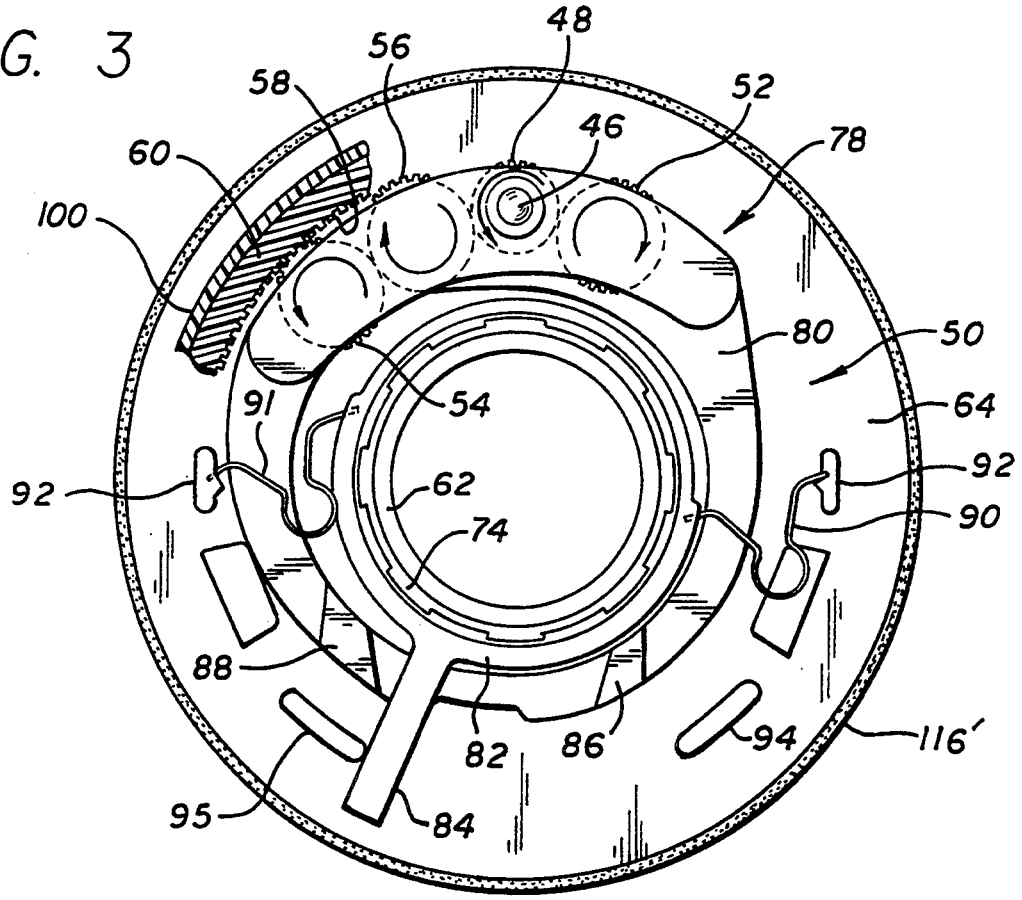
FIG. 3 is a top plan view, partly in cross-section, of a shifting gear transmission and support base employing the present invention, and shown without the pop-up stem.

As shown in the FIG. 3, the shiftable gear transmission 50 is of generally conventional design and quite similar in operation to that described in the aforementioned U.S. Pat. No. 3,107,056. As shown herein, the shiftable gear transmission 50 includes a four gear arrangement including two oppositely rotating terminal gears 52 and 54 driven by the drive gear 48 coupled to the output shaft 46 of the gear train, an idler gear 56 being interposed between the drive gear and the terminal gear 54 so that its direction of rotation is opposite that of terminal gear 52, as shown by the directional arrows of FIG. 3.

To effect rotation of the nozzle housing 22, one or the other of the terminal gears 52 and 54 is positioned to engage a ring gear 58 formed around the inner periphery of a cup-shaped driven member 60 non-rotatably secured to a tubular riser 62 extending centrally through and fixed within the nozzle housing 22. The riser 62 communicated at its upper end with the nozzle 24, and its lower end projects downwardly inside the stem 26 and is journaled to the stem for relative rotation. As shown in FIG. 1, the upper end of the stem 26 includes a radially inwardly extending end portion 27 having a centrally disposed opening 29 through which the lower end of the riser 62 projects, and which serves as a journal mounting for the riser and nozzle housing 22.

As best seen in FIG. 1, the upper end of the gear housing 44 is rigidly secured to a generally disk shaped support base 64 dimensioned to be received and retained inside the stem 26 so as to form a partition across the inside of the stem. As shown herein, the base 64 effectively divides the inside of the stem 26 into a lower fluid chamber 66 and an upper chamber 68 within which the shiftable gear transmission 50 is contained. Disposed centrally through the base 64 in line with the passageway through the tubular riser 62 is a water passageway through which water from the lower chamber 66 can travel into the riser to the nozzle 24, the tubular riser including a lower end portion which is journaled within an upstanding cylindrical mounting boss 74 integrally formed with the base 64. Preferably, a suitable seal such as an O-ring (not shown) is disposed between the tubular riser 62 and the mounting boss 74 to prevent water from flowing into the upper chamber 68 between the riser and boss. Thus, water entering the inlet 14 of the case 12 flows upwardly through the lower chamber 66 and and around the gear housing 44 into the tubular riser 62 which directs the water outwardly through the nozzle 24.

The support base 64 forms a mounting for the shiftable gear transmission 50 disposed within the upper chamber 68. As best seen in FIG. 3, the shiftable gear transmission 50 includes a shiftable gear carrier 78 to which the terminal gears 52 and 54, idler gear 56 and drive gear 48 are rotatably mounted. The gear carrier 78 includes a ring shaped bottom plate 80 resting on the upper surface of the support base 64 and an arcuate top plate 81 spaced vertically above the bottom plate so as to capture the terminal gears 52 and 54, idler gear 56 and drive gear 48 therebetween. The gear carrier 78 is supported on the base 64 so that it is free to pivot about the axis of the output shaft 46 of the drive gear 48. Pivoting of the gear carrier 78 about the output shaft 46 moves one or the other of the terminal gears 52 and 54 into engagement with the ring gear 58 coupled to the riser 62.

To effect shifting of the gear carrier 78, a trip collar 82 is rotatably mounted around the upstanding boss 74 of the support base 64, and includes a radially outwardly projecting trip arm 84. The trip arm 84 is disposed to overlie the bottom member 80 of the gear carrier 78 and to engage one or the other of two upstanding radially spaced tabs 86 and 88 formed on the opposite side of the gear carrier from the output shaft 46. Movement of the trip arm 84 into engagement with one or the other of the tabs 86 and 88 effects a shifting of the gear carrier 78 about the axis defined by the output shaft 46 so as to move one or the other of the terminal gears 52 and 54 into engagement with the ring gear 58. As depicted in FIG. 3, terminal gear 54 is shown engaged with the ring gear 58 to effect rotation of the ring gear in a counterclockwise direction. Upon shifting of the trip arm 84 from the position shown in FIG. 3 in a counterclockwise direction to engage the tab 86, the gear carrier 78 will similarly be pivoted counterclockwise to disengage terminal gear 54 from the ring gear 58 and engage terminal gear 52 with the ring gear, thereby reversing the direction of rotation of the ring gear and hence, the nozzle housing 22 and nozzle 24.

Since it is desirable to effect a snap action of the shiftable gear transmission 50 from one direction of rotation to the other, a pair of overcenter springs 90 and 91, herein Omega type springs, are mounted between the trip collar 82 and upstanding mounting posts 92 integrally formed with the support base 64. While snap action operation of the shiftable gear transmission 50 by the overcenter springs 90 and 91 is believed to be well understood by those familiar with part circle gear driven rotary sprinklers, it will be noted that as the trip arm 84 is moved from the position illustrated in FIG. 3 in a counterclockwise direction, the overcenter springs 90 and 91 will compress and store energy until the trip arm has reached the midpoint of its travel, at which time the stored energy of the overcenter springs is released causing the trip collar 82 and trip arm to "snap" overcenter to the new counterclockwise direction. As seen in FIG. 3, radially spaced upstanding stop posts 94 and 95 are integrally formed with the support base 64 to limit the arcuate movement of the trip arm 84. The spacing between the stop posts 94 and 95 is made to be slightly larger than the radial spacing between the tabs 86 and 88 of the gear carrier 78, and are disposed to limit displacement of the trip arm such that each of the overcenter springs 90 and 91 maintain some bias force on the trip collar 82 at all times to ensure that the engaged terminal gear 52 or 54 is maintained in driving engagement with the ring gear 58.

Figure 4:
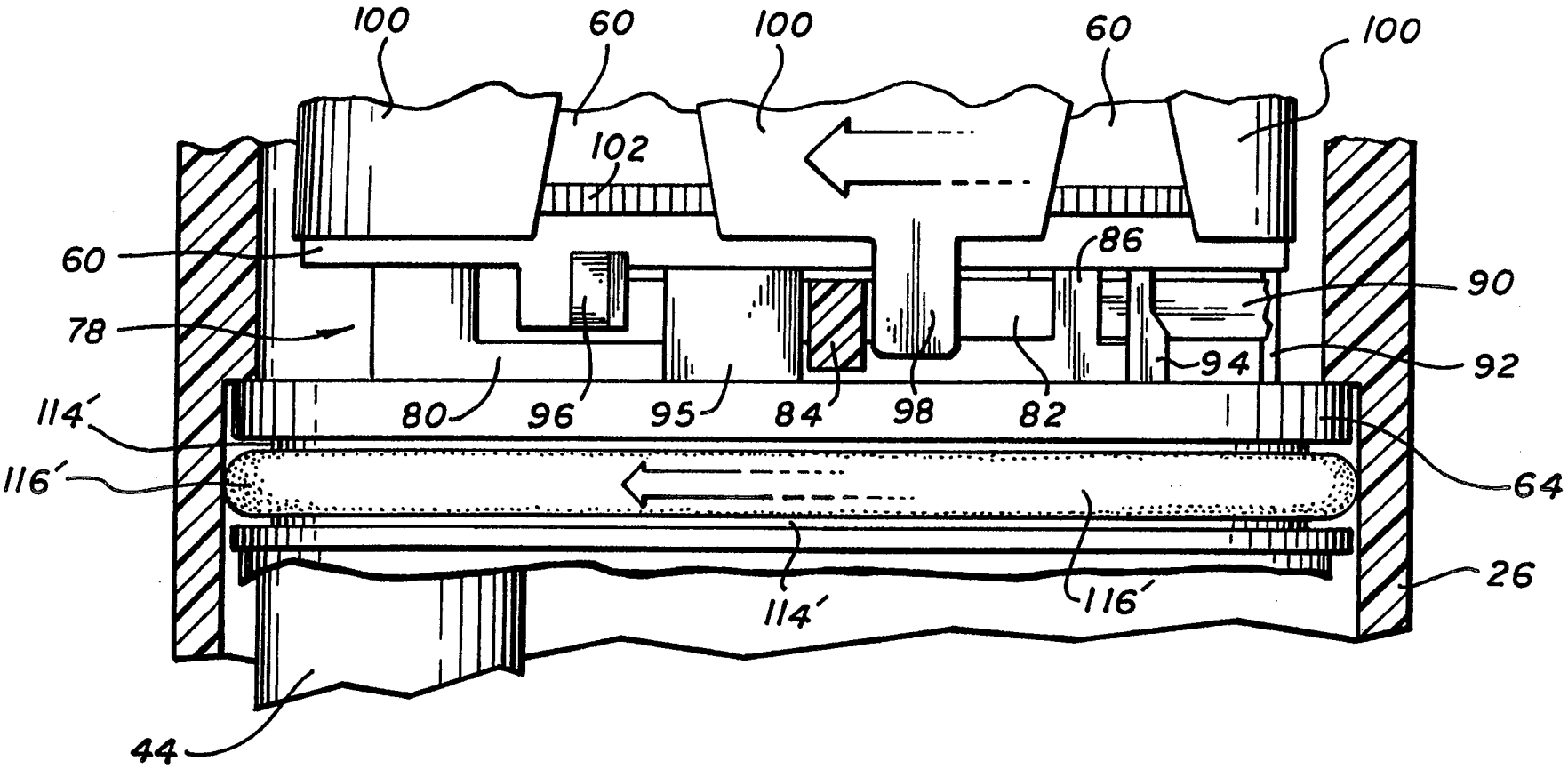
FIG. 4 is a side elevational view, partly in cross-section, showing the shiftable gear transmission and support base of FIG. 3 as assembled in the pop-up stem.

As best seen in FIGS. 1 and 4, to effect a shifting of the trip arm 84 at the end of each arcuate segment to be watered, a first trip stop 96 is carried by the ring gear 58 and formed as a downwardly projecting tab extending from the lower end of the cup-shaped driven member 60. To disengage terminal gear 52 from the ring gear 58 during clockwise rotation of the nozzle housing 22, a second trip stop 98 is formed on a cup-shaped adjustment member 100 concentrically disposed over the driven member 60 and normally coupled thereto for rotation therewith. Typically, the coupling between the driven member 60 and adjustment member 100 includes a complimentary serrated tooth connection which normally couples the two together, but which can be overridden or released to permit relative rotation. In the embodiment depicted in FIGS. 1 and 4, the driven member 60 is coupled to the adjustment member 100 by a flexible serrated tooth connection which can be ratcheted through a locking of the adjustment member to the stem 26 and, once locked against rotation, a forcible rotation of the nozzle housing 22 to cause the driven member to slip and ratchet relative to the locked adjustment member. One set of serrated teeth 102 disposed about the outer periphery of the driven member 60 is shown in FIG. 4, it being understood that a complimentary set of serrated teeth are formed circumferentially around the inside of the overlying cup-shaped adjustment member 100. Couplings of this general type are described in the aforementioned U.S. Pat. No. 3,07,056. Alternatively, the coupling between the driven member 60 and the adjustment member 100 can be of the type wherein a release of the two members is accomplished by disengagement of one member from the other, such as described in the aforementioned U.S. Pat. No. 4,634,052.

In the condition shown in FIG. 3, as the ring gear 58 rotates in the counterclockwise direction the first trip stop 96 carried by the driven member 60 will engage the trip arm 84 and carry the trip arm through the overcenter position. Once the trip arm 84 has been moved through the overcenter position, the overcenter springs 90 and 91 will snap the trip arm to the new position against stop post 92, the trip arm engaging the tab 86 of the gear carrier 78 and effecting a shifting of the gear transmission 50 prior to reaching the stop 94. This, in turn, disengages terminal gear 54 from the ring gear 58, and causes terminal gear 52 to be biased into driving engagement with the ring gear, thereby reversing the direction of ring gear rotation.

In a similar manner, as the terminal gear 52 rotates the ring gear 58 and nozzle housing 22 in a clockwise direction as seen in FIG. 3, the second trip stop 98 on the adjustment member 100 will engage the trip arm 84 causing the arm to shift clockwise and engage the tab 88 to pivot the gear carrier 78 about the axis of the drive shaft 46, thereby disengaging terminal gear 52 from the ring gear 58 and engaging terminal gear 54 therewith. The relative arcuate spacing between the first and second trip stops 96 and 98 thus determines the arcuate limits of oscillation of the nozzle housing 22 and nozzle 24.

It is important to note that the first trip stop 96 of the driven member 60 is fixed in location relative to the nozzle housing 22 by virtue of being non-rotatably secured to the riser 62, and it is only the second trip stop 98 which can be arcuately moved and adjusted with respect to the nozzle housing. Thus, once the nozzle housing 22 has been assembled with the stem 26, the arcuate location of the first trip stop 96, and hence the nozzle 24, is also fixed with respect to the trip arm 84 so that one arcuate limit of rotation is established. That is, as viewed in FIG. 3, since counterclockwise rotation of the ring gear 58 will result in the first trip stop 96 always engaging the trip arm 84 at the same rotary position of the nozzle housing 22 and riser 62, the arcuate position of the nozzle 24 at which the gear carrier 78 is shifted to disengage terminal gear 54 and engage terminal gear 52 to drive the nozzle housing clockwise will always remain the same. Accordingly, the right, or maximum counterclockwise extent of nozzle rotation is always fixed, so long as the shiftable gear transmission 50 and motor 38 do not rotate relative to the stem 26.

Prior to the present invention, it was believed to be necessary that the rotary position of the shiftable gear transmission 50 and motor 38 relative to the stem 26 remain fixed at all times. Traditionally, this was thought to be necessary since when a sprinkler 10 is installed, the installer will initially position the case 12 in the ground and tightly couple the case to the supply pipe 15. Thereafter, the pop-up assembly 20 is inserted into the case 12 to rotationally align the nozzle 24 along the desired maximum counterclockwise direction. This is accomplished by selecting the position of the grooves 30 on the lower end of the stem 26 with the case ribs 32 so that the nozzle 24 is pointing in the selected direction. Thereafter, the rotary position of the second trip stop 98 relative to the first trip stop 96 is set so that the desired arc of rotation in the clockwise direction is achieved. The nozzle 24 will now water an arc segment defined by the distance between the first and second trip stops 96 and 98, and, unless the pop-up assembly 20 is removed from the case 12, changes in the arc can only be made to increase or decrease the extent of clockwise nozzle rotation.

To insure that the shiftable gear transmission 50 and motor 38 remain fixed against rotation, the prior art typically employed techniques, such as bonding or keying to non-rotatably mount the gear housing 44 and/or base 64 inside the stem 26. For example, in the aforementioned Toro "Super 600" sprinkler, the gear housing and base are non-rotatably bonded, such as by welding or gluing to the inside of the stem. In the Rain Bird "T-Bird" sprinkler, such as shown on page 40 of its 1993–1994 Landscape Irrigation Products catalogue, the base is keyed to the inside of the stem.

Figure 2:
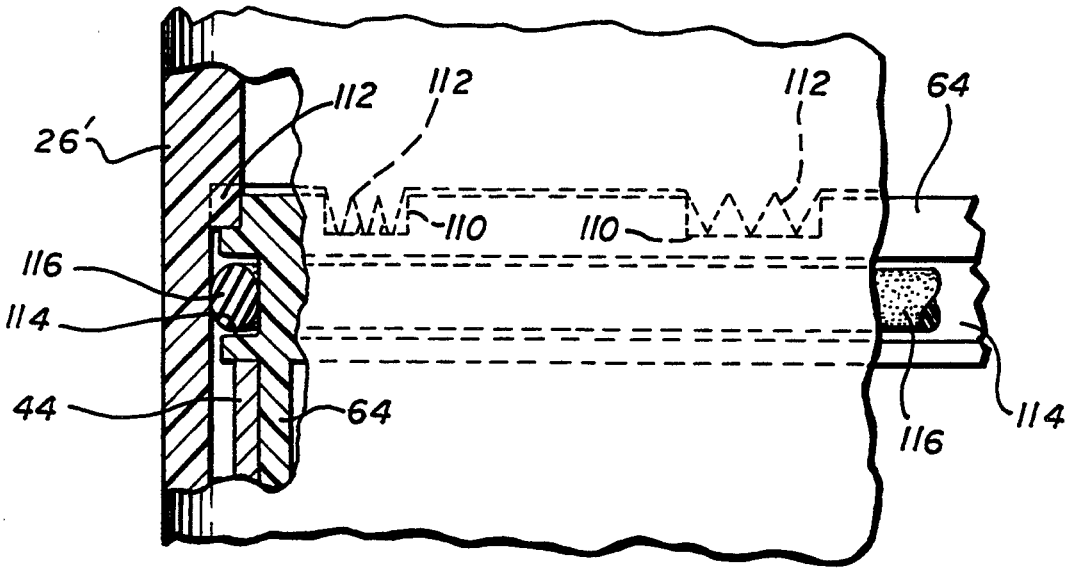
FIG. 2 PRIOR ART
FIG. 2 is an enlarged, fragmentary perspective view, partly in cut-away cross-section, of a prior art sprinkler showing a non-rotatable mounting of a support base within the pop-up stem.

Shown in FIG. 2 is a prior art representation of the key mounting technique employed in the Rain Bird "T-Bird" sprinkler. As shown therein, the base 64' is formed with a plurality of upwardly open recesses 110 spaced circumferentially around the upper peripheral surface, and which mate with correspondingly located downwardly projecting keys 112 formed to extend radially inwardly around the inside of the tubular stem 26'. Mating of the keys 112 within the recesses 110 positively prevents the support base 64', as well as the shiftable gear transmission supported thereon and the gear housing 44 secured thereto, from rotating within the stem 26'. In this instance, as shown in FIG. 2, the base is formed within a peripheral annular groove 114 within which is mounted an O-ring type seal 116 for preventing water within the lower chamber 66 from passing between the base and stem into the upper chamber 68. While use of such an O-ring seal 116 is desirable with the key type mounting depicted in FIG. 2, for assemblies employing a bonding, welding or gluing techniques, such as used in the Toro "Super 600", no such seal has typically been required since the bond itself forms a water tight interface seal.

Normally, when the pop-up assembly 20 is assembled, the shiftable gear transmission 50 is assembled on the base 64 to which motor 38 and gear housing 44 is secured, and this subassembly is then installed within the stem 26 through the bottom and secured in place. As mentioned, in the Toro "Super 600" sprinkler, this subassembly is secured by bonding to the stem, while in the Rain Bird "T-Bird" sprinkler, the friction of the O-ring 116 is sufficient to hold the subassembly in its axial position within the stem 64, and the recesses 110 and keys 112 secure the subassembly against rotation.

As previously mentioned, sprinklers of the type to which the present invention relates are typically made from molded plastic parts and components, typically from materials such as acetal, ABS and others. As a consequence, while the use of plastic has substantially reduced the costs of manufacture and assembly, the resultant sprinklers are prone to damage through vandalism.

One major problem that has long been recognized is that of breakage caused by excessive torque being applied to the nozzle housing 22 when the sprinkler is not in operation. Typically, a vandal will pry up the pop-up assembly 20 from within the case 12, and then forcibly rotate the nozzle housing 22 in one or both directions. If the vandal attempts to rotate the nozzle housing 22 in a direction opposite to that which the sprinkler 10 was rotating at the time the irrigation cycle had been discontinued, the gearing will "lock-up." For example, if a vandal attempted to rotate the nozzle housing 22 clockwise from the position shown in FIG. 3, the teeth of the ring gear 58 will attempt to rotate the terminal gear 54 in reverse and pull the teeth of the terminal gear more firmly into engagement with the ring gear. However, due to the inherent high frictional resistance of the upstream gearing of the gear train, the terminal gear 54 and ring gear 58 will lock-up so that the terminal gear will not rotate in reverse. A continued application of excessive torque in this direction will result in breakage of the ring gear 58, terminal gear 54, or possible other of the upstream gears.

If a vandal attempts to rotate the nozzle housing 22 in the same direction in which the sprinkler 10 was rotating at the time normal operation was stopped, the nozzle housing will rotate relatively freely until the associated trip stop 96 or 98 engages the trip arm 84 and pushes it overcenter and against the associated stop post 94 or 95. Any further application of excessive torque will then cause the trip stop 96 or 98, or the trip arm 84, or possibly both, to shear off or break. For example, as shown in FIG. 4, if the nozzle housing 22 is attempted to be further rotated in the clockwise direction to the left, it can be seen that since the trip arm 84 is abutting the stop post 95, unless the base 64 could rotate relative to the stem 26, further movement of the trip stop 98 can only occur if one of the engaged elements breaks. Notably, an average adult typically is capable of applying up to about 500 inch-ounces of torque to the nozzle housing 22 of a conventional sprinkler 10.

In accordance with the present invention, the problem of breakage caused by excessive torque being applied to the nozzle housing 22 when the sprinkler 10 is not operating has been solved by eliminating the heretofore thought to be required means for positively preventing the relative rotation of the base 64 and its associated gear train housing 44 and shiftable gear transmission 50, with respect to the stem 26, and substituting therefor a slip clutch which permits the base to rotate within the stem whenever torque levels above a preselected level are applied to the nozzle housing of the nonoperating sprinkler. Moreover, provision of the slip clutch now permits an operator to very accurately adjust the position of the fixed stop position of the nozzle 24 without requiring that the pop-up assembly 20 be removed from and repositioned back into the case 12 since the operator is now free to manually apply torque to the nozzle housing 22 without fear of breaking parts within the sprinkler.

Toward the foregoing ends, as best seen in FIG. 4, a slip clutch connection is formed between the base 64 and the inner sidewall of the stem 26 by selecting and dimensioning the heretofore used O-ring seal 116' to not only serve as a fluid barrier to the passage of water between the base and stem, but also to act as the sole means for retaining the base within the stem and preventing relative rotation at all torque levels below those encountered under the normal operating conditions. Thus, the base 64 and its associated shiftable gear transmission 50 and motor 38, are not positively prevented from rotating relative to the stem 26, but rather are releasably retained by the friction interface fit of the O-ring 116' compressed between the base and stem.

In tests of a commercial Rain Bird "T-Bird" part circle sprinkler, it was found that under normal operating conditions, torque levels of about 7 to 10 inch-ounces were experienced during reversal of the shifting gear transmission 50. It was also found that the application of torque levels to the nozzle housing 22 above about 240 inch-ounces could produce damage to the plastic components of the shiftable gear transmission 50. Accordingly, by properly selecting the dimensions of the O-ring 116' to produce a friction interface fit between the stem 26 and base 64 which prevents rotation at torque levels at or below approximately 25 inch-ounces, but permits slip to occur at torque levels below about 200 inch-ounces, the base will remain stationary relative to the stem during normal sprinkler operation, but will slip upon the application of torque levels which could cause damage to the sprinkler plastic components, thereby preventing such damage.

In actual application of the present invention, it has been found that satisfactory results can be achieved in a Rain Bird "T-Bird" part circle sprinkler by using an O-ring 116' formed by Nitril or Buna N (NBR) material having a Shore hardness of 70A(+/−5A) and dimensioned to have a cross-sectional thickness of 0.070 inches and an internal diameter of 1.176 inches. This O-ring 116' is mounted to a base 64 having an overall diameter of 1.307 inches and formed with an annular groove 114' having an axial height of 0.098 inches and an inside diameter of 1.196 inches, and installed within a four inch stem 26 having an inside diameter in the area of engagement with the O-ring of 1.315 inches. Tests conducted on ten different Rain Bird "T- Bird" sprinklers using the foregoing O-rings 116' were found to require an applied torque to the nozzle housings 22 of between 30 inch-ounces and 77 inch-ounces with an average of 61 inch-ounces before rotational slippage of the base 64 relative to the stem 26 would occur. These values are well within the limits required for preventing rotation of the base 64 during normal operation, yet permitting slippage before breakage can occur.

From the foregoing, it can be appreciated that by appropriate selection of the material and dimensions of the O-ring 116' the amount of torque required to be applied to the nozzle housing 22 to overcome the O-ring friction can be controlled, and the base 64 can be made to remain in its proper rotary position within the stem 26 unless and until a preselected level of torque is applied to the nozzle housing, that level of torque being selected to be below that at which damage or breakage of the plastic components may occur, typically below about 200 inch-ounces, but above about 25 inch-ounces. While the foregoing description has been presented in connection with the application of the present invention to a Rain Bird "T-Bird" sprinkler, it should be apparent that the principles of this invention can equally be applied to many other part circle, gear driven rotary sprinklers, such as, for example, those disclosed in the aforementioned United States patents. Further, while a particular form of the present invention has been illustrated and described, it will be apparent that various modifications and changes can be made without departing from the spirit and scope of the invention.

What is claimed is:

1. In a pop-up, part circle gear driven rotary irrigation sprinkler of the type including a sprinkler case within which is mounted a pop-up assembly adapted to move between a retracted, non-operating condition with the pop-up assembly disposed within the case and an extended operating condition with the pop-up assembly projecting above the case, the pop-up assembly including a nozzle housing rotatably coupled to an upper end of a generally hollow cylindrical stem keyed for sliding, non-rotating motion within the case, and a support housing disposed within the stem below the nozzle housing, the support housing including a base portion adapted to divide the stem into upper and lower chambers, a shiftable gear transmission drivingly coupled to the nozzle housing and mounted to the base within the upper chamber, and a water operated gear motor drivingly coupled to the shiftable gear transmission and secured to the base within the lower chamber, the improvement comprising:

slip clutch releasably restraining said support housing against rotation within said stem, said slip clutch permitting said support housing to rotate relative to said stem whenever an external torque above a predetermined level is applied to said nozzle housing whereby upon application of said external torque above said predetermined torque level, said nozzle housing will rotate said support housing relative to said stem.

2. The improvement as set forth in claim 1 wherein said slip clutch means comprises an elastomeric O-ring compressed between said support housing and said stem to produce a friction interface fitting therebetween.

3. The improvement as set forth in claim 2 wherein said predetermined torque level is about 25 inch-ounces.

4. The improvement as set forth in claim 3 wherein said elastomeric O-ring is formed from Nitril rubber having a Shore hardness of about 70A.

5. The improvement as set forth in claim 1 wherein said base portion is of generally circular horizontal cross-section and said slip clutch comprises an annular O-ring extending peripherally around said base and compressed against said stem to produce a friction interface fitting therebetween.

6. The improvement as set forth in claim 5 wherein said O-ring is formed of rubber, and said predetermined torque level is about 25 inch-ounces.

7. The improvement as set forth in claim 6 wherein said O-ring is formed of Nitril rubber having a Shore hardness of about 70A.

8. The improvement as set forth in claim 6 wherein a peripheral annular groove is formed around said base, and said O-ring is mounted within said groove.

* * * * *

UNITED STATES PATENT AND TRADEMARK OFFICE

CERTIFICATE OF CORRECTION

PATENT NO. : 5,383,600

DATED : January 24, 1995

INVENTOR(S) : Steven Verbera, Timothy C. Sexton

It is certified that error appears in the above-identified patent and that said Letters Patent is hereby corrected as shown below:

Column 11, claim 2, line 14, after the word "clutch" and before "comprises", delete the word [means].

Signed and Sealed this

Eleventh Day of April, 1995

*Attest:*

Bruce Lehman

BRUCE LEHMAN

*Attesting Officer*

*Commissioner of Patents and Trademarks*